US008052469B2

(12) United States Patent
Mao et al.

(10) Patent No.: US 8,052,469 B2
(45) Date of Patent: Nov. 8, 2011

(54) ELECTRICAL CONNECTOR WITH A METALLIC SHELL WITH A MATING OPENING DIVIDED INTO TWO DIFFERENT INTERFACES

(75) Inventors: Yu-Hua Mao, Kunshan (CN); Zhi-Hong Fang, Kunshan (CN); Fa-Chun Wang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 36 days.

(21) Appl. No.: 12/626,951

(22) Filed: Nov. 30, 2009

(65) Prior Publication Data

US 2010/0136831 A1 Jun. 3, 2010

(30) Foreign Application Priority Data

Nov. 28, 2008 (CN) ..... 2008 10 305844

(51) Int. Cl.
*H01R 13/648* (2006.01)

(52) U.S. Cl. ..... 439/607.01

(58) Field of Classification Search ..... 439/607.01, 439/607.58, 660, 541.5, 680
See application file for complete search history.

(56) References Cited

U.S. PATENT DOCUMENTS

| | | | | |
|---|---|---|---|---|
| 7,467,977 | B1 * | 12/2008 | Yi et al. | 439/607.01 |
| 7,578,700 | B2 * | 8/2009 | Xiong et al. | 439/607.01 |
| 2008/0299828 | A1 * | 12/2008 | Gu et al. | 439/607 |
| 2009/0298336 | A1 * | 12/2009 | Xiong et al. | 439/607.01 |

FOREIGN PATENT DOCUMENTS

CN 200720034623.6 2/2008

* cited by examiner

*Primary Examiner* — Chandrika Prasad
(74) *Attorney, Agent, or Firm* — Andrew C. Cheng; Wei Te Chung; Ming Chieh Chang

(57) ABSTRACT

Provided is an electrical connector including an insulative housing having a main body and a pair of tongue plates perpendicular extending from said main body along a mating direction. Said tongue plates are parallel to each other and each defines a plurality of terminal grooves thereon. A plurality of terminals are received in the terminal grooves. A metallic shell is retained on the main body of the insulative housing and encloses said pair of tongue plates thereby defining a mating opening therein. The mating opening defines a first and a second different interfaces in communication with each other. At least a partition portion protrudes toward the mating opening from said main body and defines a bottom surface to act as a top wall of the second interface.

18 Claims, 13 Drawing Sheets

ELECTRICAL CONNECTOR WITH A METALLIC SHELL WITH A MATING OPENING DIVIDED INTO TWO DIFFERENT INTERFACES

BACKGROUND OF THE INVENTION

1. Cross Reference

The present invention is related to "Electrical Connector" submitted on May 5, 2009 with Ser. No. 29/336,471, and "Cable Connector" submitted contemporaneously on the same date with Ser. No. 29/336,470, invented by the same inventors and commonly assigned to the same assignee.

2. Field of the Invention

The present invention relates to a cable assembly, and more particularly to a cable assembly integrated with first and second interfaces intended for interconnecting corresponding interfaces altogether.

3. Description of the Related Art

Chinese Utility Patent No. 200720034623.6 issued to Gu et al. on Feb. 27, 2008 disclosed a conventional electrical connector with at least two interfaces included therein. Referring to FIG. 12, the electrical connector is provided with an insulative housing mounted a plurality of terminals 2 therein and surrounded by a metallic shell 3. The insulative housing 1 forms a pair of tongue plates 11 and a partition board 12 located between said tongue plates so as to create two mating interfaces in the front of the insulative housing.

The arrangement of the partition board 12 could increase the rigidity of the insulative housing at one hand, however, the flip side is that it increases the height of the insulative housing at the same time and is not advantageous for the miniaturization trend of the electrical connector. If the partition board 12 of the insulative housing is omitted, the overall height of the insulative housing is surely and tremendously reduced, however, a boundary between the two mating interfaces is not properly defined, if a mating plug is inserted therein, a steady and reliable electrical connection therebetween can not be assured because the mating plug may shake in the vertical direction. Moreover, the reduction of the height of the insulative housing will only allow one plug to be inserted into at one time, and do not allow the two plugs to be inserted into simultaneously. Obviously, an improved electrical assembly is highly desired to overcome the aforementioned problem.

SUMMARY OF THE INVENTION

Accordingly, an object of the present invention is to provide an electrical receptacle defining two different mating interfaces at one single port.

In order to achieve the object set forth, an electrical connector includes an insulative housing having a main body and a pair of tongue plates perpendicular extending from said main body along a mating direction. Said tongue plates are parallel to each other and each defines a plurality of terminal grooves thereon. A plurality of terminals are received in the terminal grooves. A metallic shell is retained on the main body of the insulative housing and encloses said pair of tongue plates thereby defining a mating opening therein. Said mating opening defines a first and a second different interfaces in communication with each other. At least a partition portion protrudes toward the mating opening from said main body and defines a bottom surface to act as a top wall of the second interface.

Other objects, advantages and novel features of the invention will become more apparent from the following detailed description of the present embodiment when taken in conjunction with the accompanying drawings.

BRIEF DESCRIPTION OF THE DRAWINGS

FIG. 2 is a perspective view of the electrical receptacle shown in

FIG. 1;

DETAILED DESCRIPTION OF THE INVENTION

Figure 1:
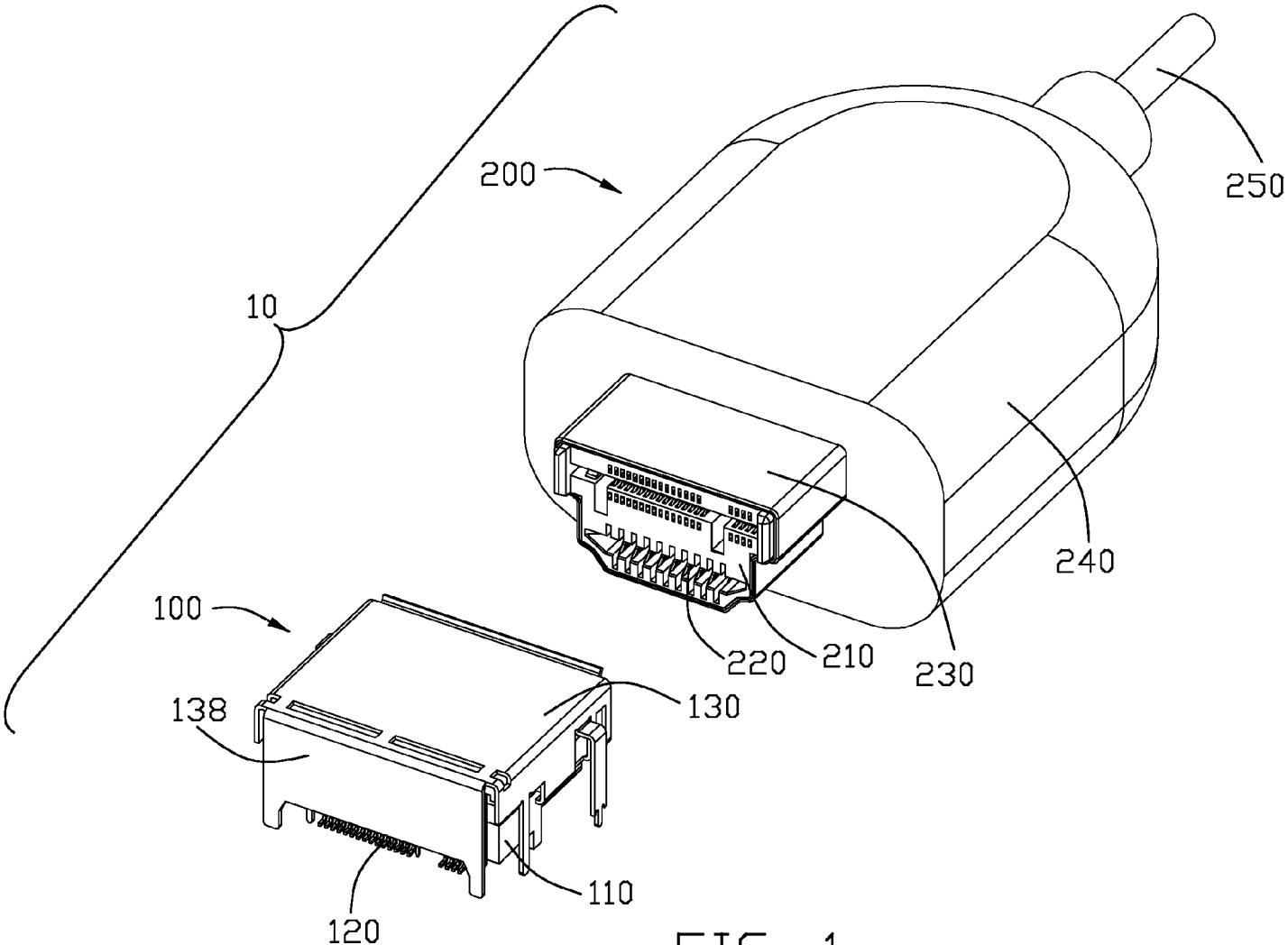
FIG. 1 is a perspective view of an electrical assembly in accordance with the present invention, which comprises an electrical receptacle and a complementary electrical plug.

Reference will now be made to the drawing figures to describe a preferred embodiment of the present invention in detail. Referring to FIG. 1, an electrical assembly 10 according to the preferred embodiment of the present invention is provided and comprises an electrical receptacle 100 and a complementary electrical plug 200 mating with said electrical receptacle 100. The electrical receptacle 100 comprises an insulative housing 110 mounted a plurality of terminals 120 therein and surrounded by a metallic shell 130. The electrical plug 200 defines a mating portion partly retained in an insulative cover 240 and a cable 250 extending rearward from the insulative cover 240. The mating portion defines an insulative base 210, conductive components 220 secured in the insulative base 210, and a shield member 230 surrounding the insulative base 210.

Figure 2:
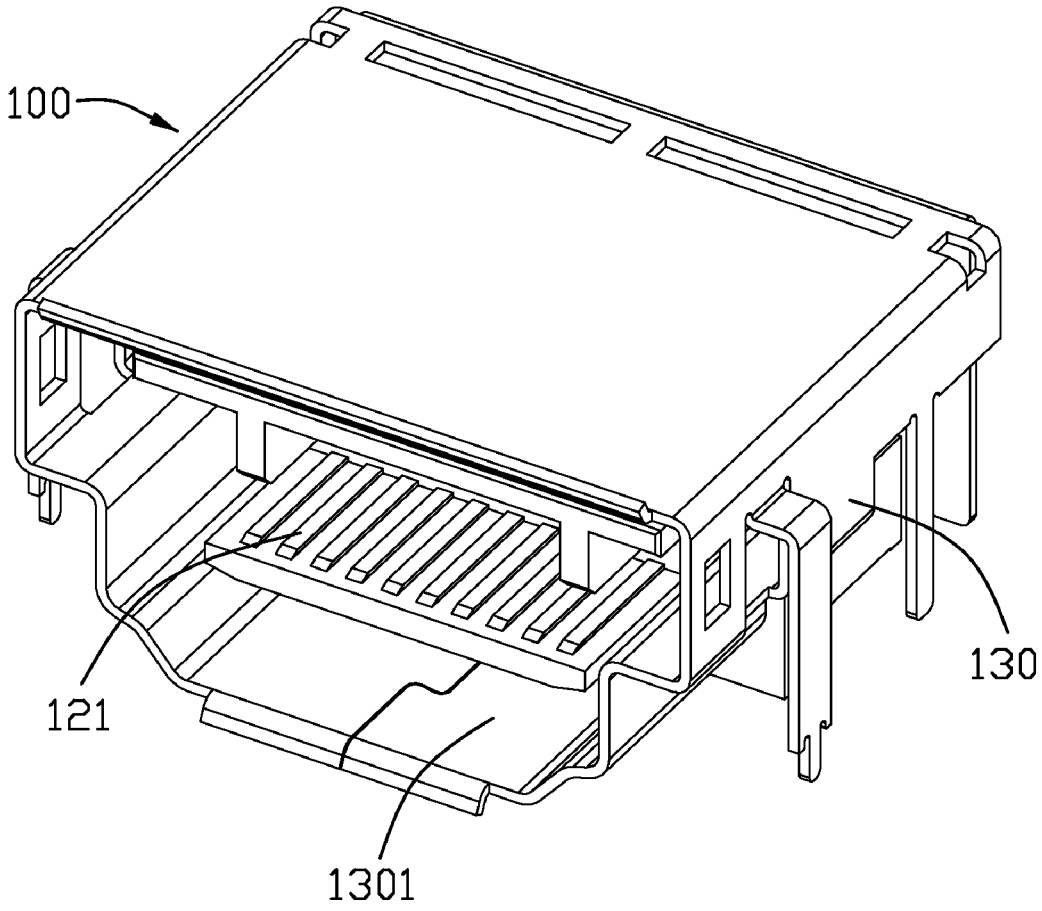
Figure 3:
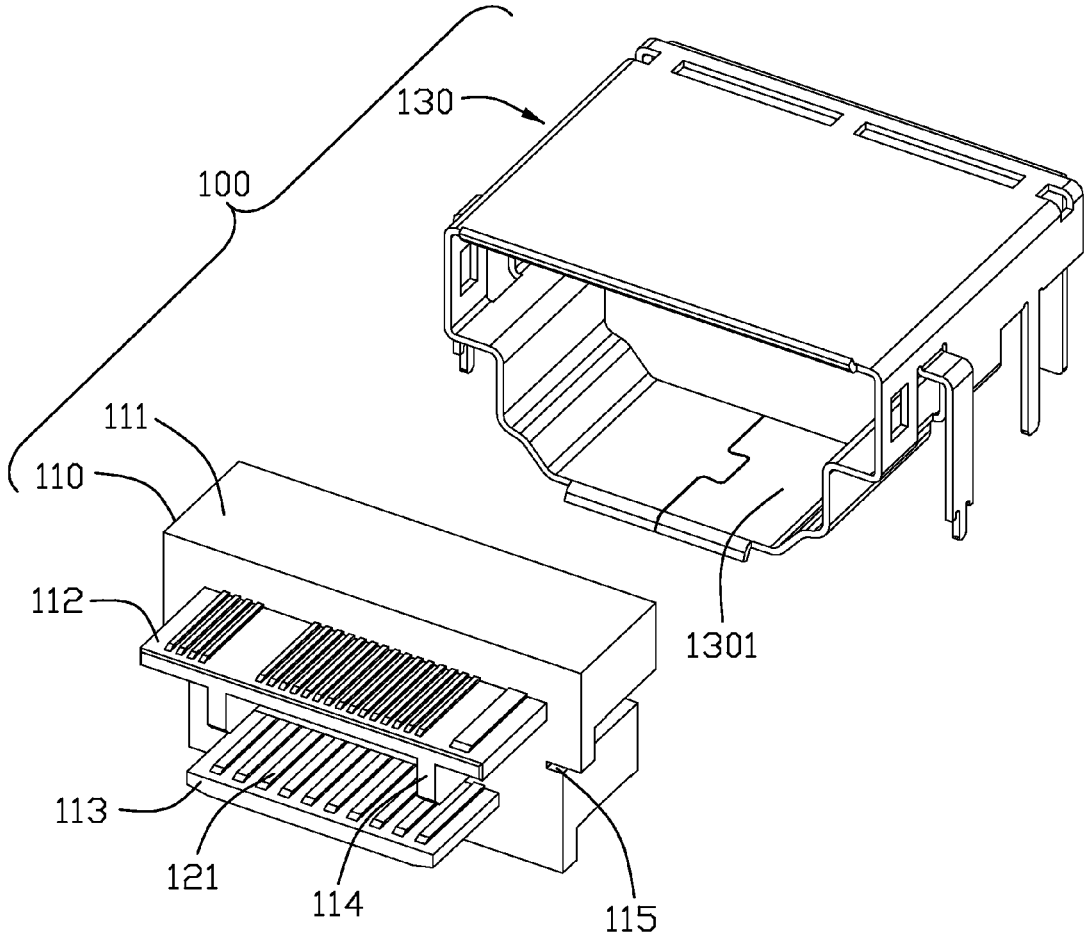
FIG. 3 is an exploded perspective view of the electrical receptacle shown in FIG. 2.

Referring to FIGS. 2 and 3, the insulative housing 110 of the electrical plug 100 defines a base 111 and a pair of tongue plates 112, 113 respectively extending forward from upper and lower side of the said base 111, and the upper tongue plate 112 is longer than the lower tongue plate 113 in a longitudinal direction. At least a rib portion 114 protrudes from a bottom side of the upper tongue plate 112 toward the lower tongue plate 113 for enhancing the rigidity of the upper tongue plate 112 and ensuring an anti-disorientation interengagement. A pair of grooves 115 are respectively defined at opposite ends of the base 111 along a mating direction. Each of the terminals

120 comprises a contacting portion 121 retained in the tongue plate and a solder portion 122 projecting out of the insulative housing 110. The metallic shell 130 encloses the insulative housing 110 and defines a mating opening 1301.

Figure 4:
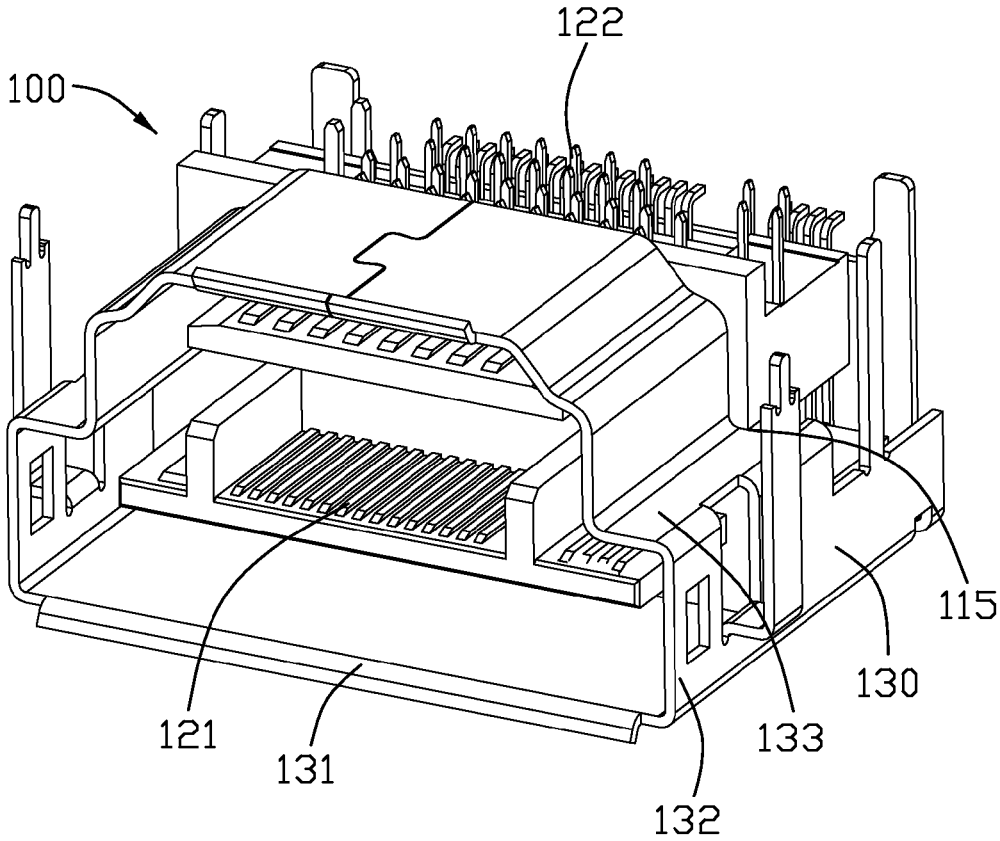
FIG. 4 is another perspective view of the electrical receptacle shown in FIG. 2, seen from a bottom side.
Figure 5:
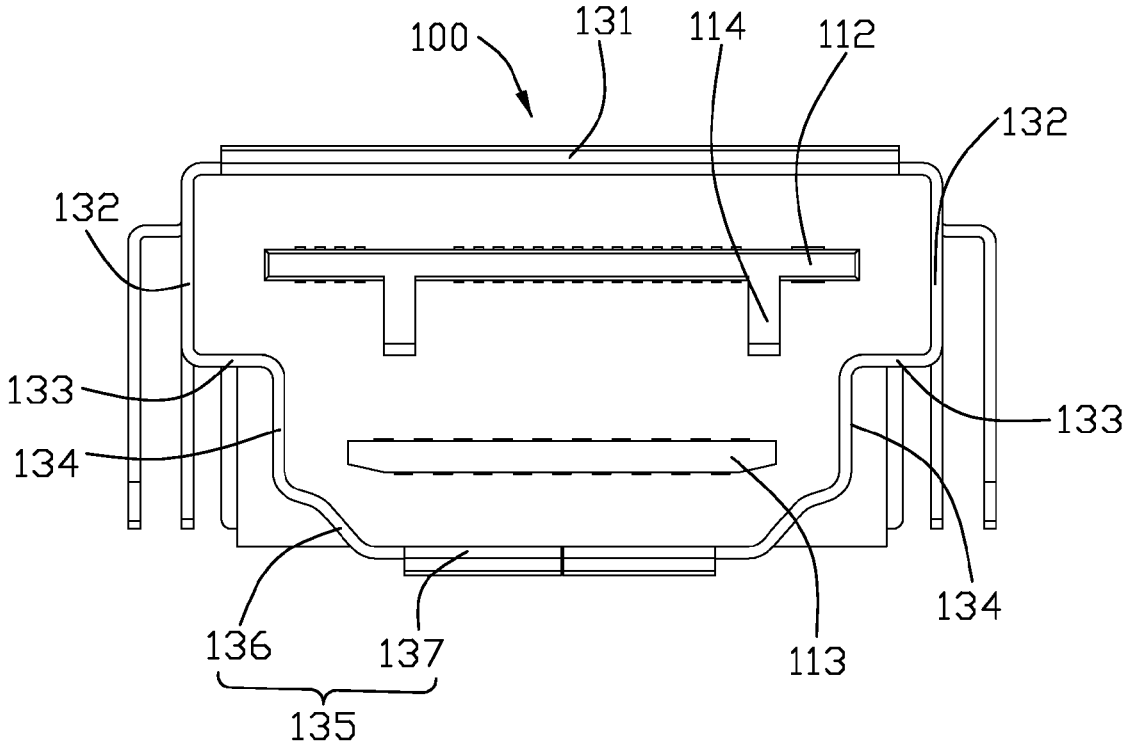
FIG. 5 is a front view of the electrical receptacle shown in FIG. 2.
Figure 5A:
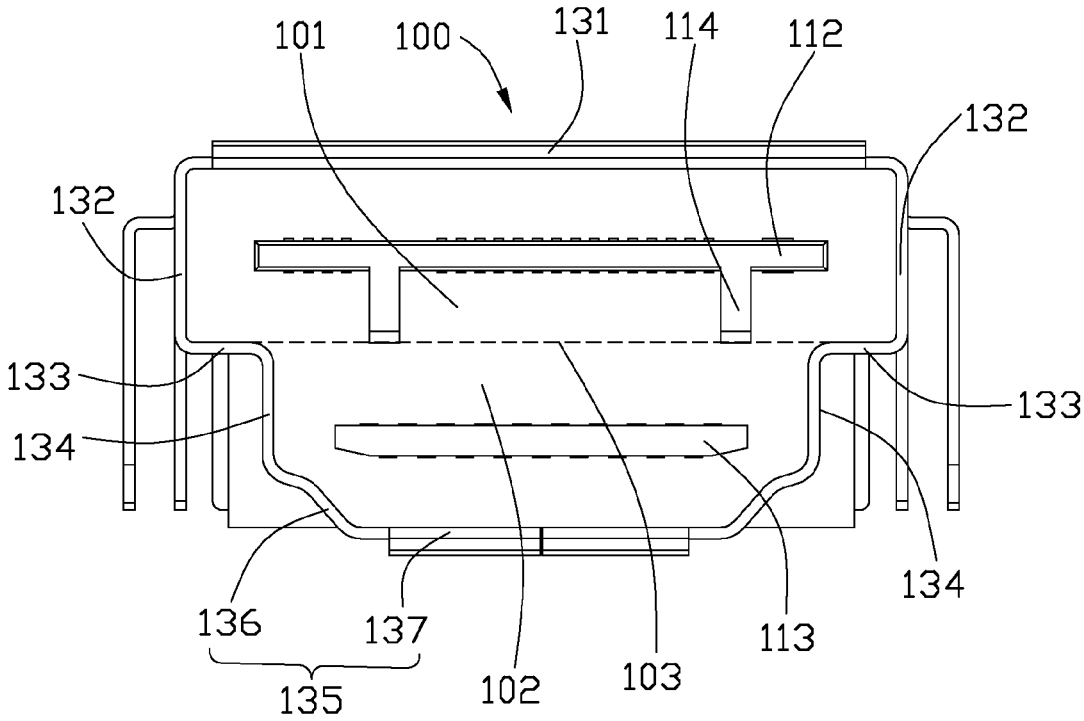
FIG. 5*a* is an illustrating view of FIG. 5 which points out the first and second interfaces.

Referring to FIGS. 4 and 5, the metallic shell 130 is made by stamping and bending a metal piece, and comprises a plurality of walls interconnected with each other so as to form the mating opening 1301. The mating opening 1301 has a top wall 131, a pair of first side walls 132 extending downward from opposite edges of the top wall 131 perpendicularly, a pair of second side walls 133 extending toward each other horizontally and respectively from said first side walls 132, a pair of third side walls 134 parallel to the first side wall 132 extending downward from the second side walls 133 respectively, and a fourth side wall 135 connecting said pair of third side walls 134. The second side walls 133 are also named as horizontal walls. As best shown in FIG. 5 and FIG. 5*a*, the distance between the pair of first side walls 132 is longer than that between the pair of third side walls 134. The upper tongue plate 112 is between the pair of first side walls 132, and the end of the rib portion 114 is in alignment with the second side walls 133 thereby a first mating opening 101 which is in a rectangular shape is defined. In addition, a second mating opening 102 is also defined by the third side walls 134, the fourth side walls 135 and the bottom side of the rib portion 114 together with the lower tongue plate 113. The second mating opening 102 is in a different configuration comparing with the first mating opening 101, and the second mating opening 102 is also named as a small interface or a second interface, while the first mating opening 101 is also named as a large interface or a first interface. An imaginary boundary 103 which is substantially an extension line of the second side walls 133 is defined between the first mating opening 101 and the second mating opening 102, and the bottom side of the rib portion 114 is coplanar with the imaginary boundary 103.

The second side walls 133 are received in the grooves 115 for retaining the metallic shell 130 on the insulative housing 110. A rear plate 138 extends downward from a rear edge of the top wall 131 for enclosing the insulative housing 110 therein. In the present invention, the fourth side wall 135 comprises a pair of slant walls 136 obliquely extending downward from the third side wall 134 and connecting with a horizontal bottom wall 137, thereby defining the second mating opening 102 as substantially the High Definition Multimedia Interface (HDMI). The first and second mating openings 101, 102 are configured into different shapes and dimensions for mating with different electrical plugs.

Figure 6:
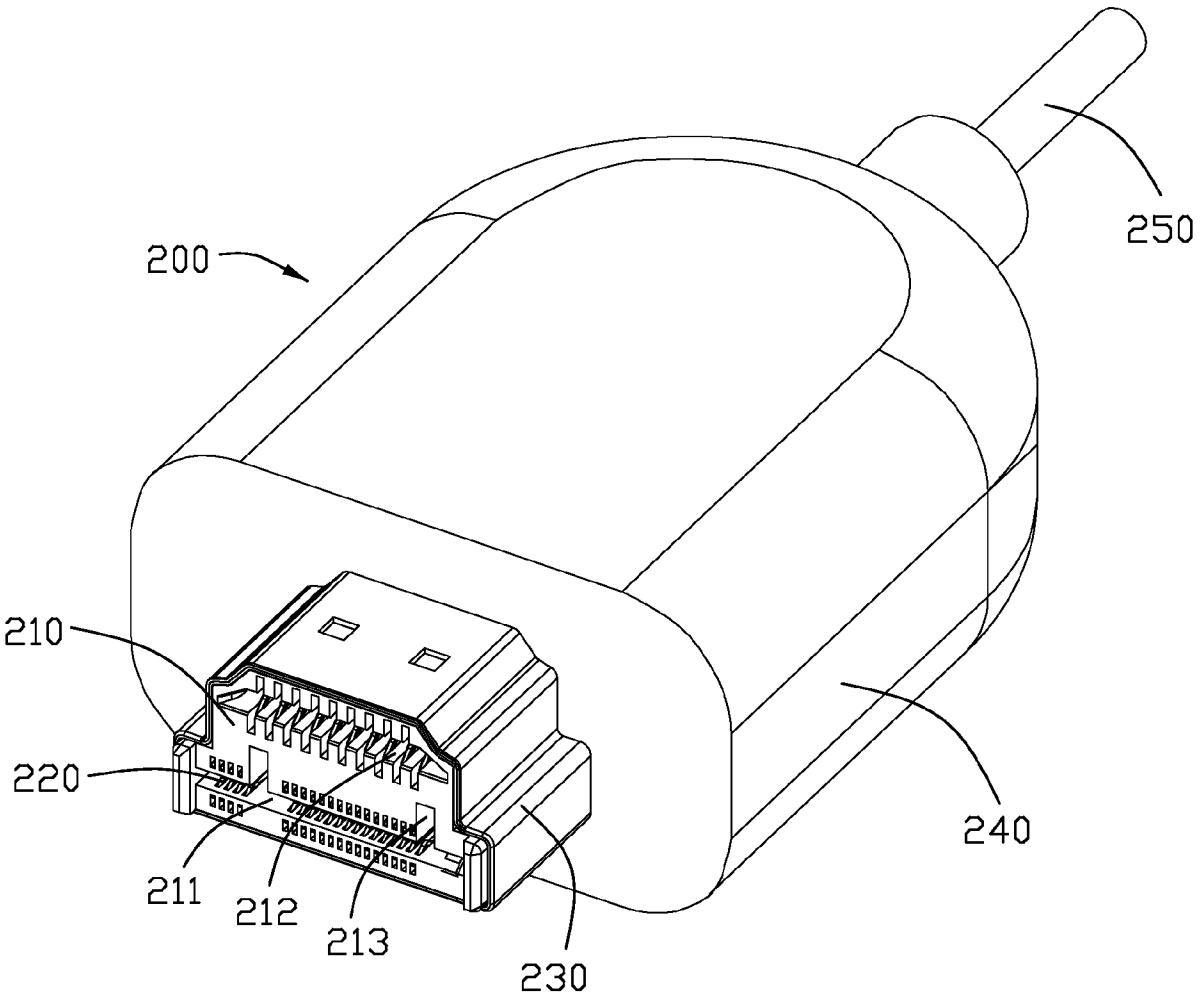
FIG. 6 is a perspective view of a first embodiment of the electrical plug shown in FIG. 1, which is adapted for being inserted into the electrical receptacle shown in FIG. 2.

FIG. 6 shows a first embodiment of the electrical plug 200 for mating with the electrical receptacle 100. The cables 250 of the electrical plug are embedded in the insulative cover 240 for connecting with the conductive components 220. The insulative base 210 defines a pair of receiving cavities 211, 212 in different configurations for respectively receiving said upper tongue plate 112 and lower tongue plate 113. At least one notch 213 is formed on the insulative base 210 and in communication with the receiving cavity 211 for receiving the rib portion 114 and guiding the electrical plug 200 to be inserted into the receiving cavity 211.

Figure 7:
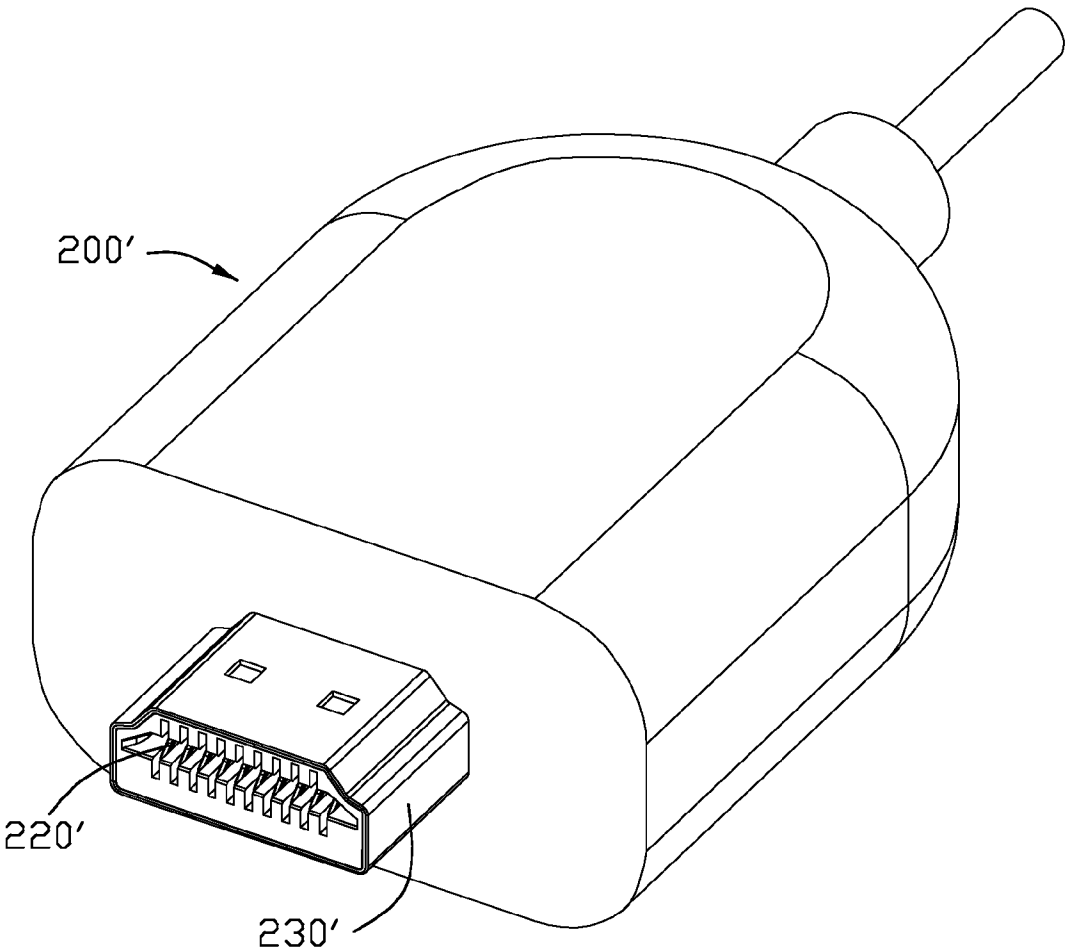
FIG. 7 is a perspective view of second embodiment of the electrical plug, which is adapted for being inserted into the electrical receptacle shown in FIG. 2.
Figure 8:
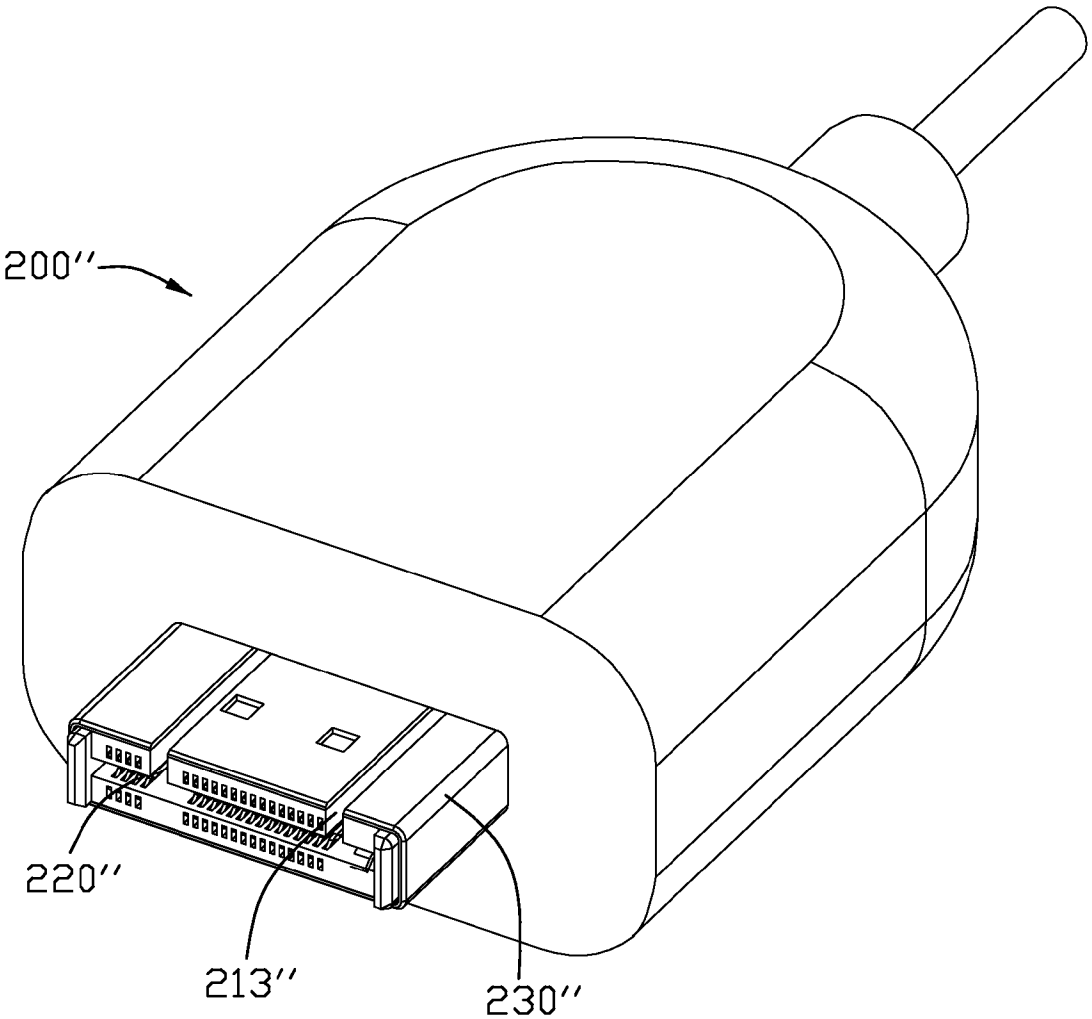
FIG. 8 is a perspective view of a third embodiment of the electrical plug, which is adapted for being inserted into the electrical receptacle shown in FIG. 2.

Referring to FIGS. 7 and 8, a second and a third embodiments of the electrical plug 200', 200" are provided, which are transformed from the first embodiment of the electrical plug 200, i.e. formed by splitting from a central line of the mating opening 1301 of the first embodiment of the electrical plug 200 along a longitudinal direction. The electrical plug 200' comprises an integrated shell 230' surrounding the housing and a receiving cavity 220' defined in the housing. The electrical plug 200" comprises an interrupted shell 230" surrounding the housing and a receiving cavity 220" defined in the housing. A pair of passageways 213" parallel to each other are respectively defined at one side of the housing to cooperate with the rib portion 114. The detailed configurations of the second and third embodiments of the electrical plug 200', 200" will be not described for simplicity.

The electrical plug 200' can be inserted into the second mating opening of the electrical receptacle 100, and the lower tongue plate 113 of the electrical receptacle 100 is inserted into the receiving cavity 220' at the same time. The rib portion 114 abuts against the shell 230' therefore the electrical plug 200' can snugly engage with the electrical receptacle 100. Additionally, the upper tongue plate 112 is longer than the electrical plug 200', therefore the upper tongue plate 112 together with the rib portion 114 can prevent the electrical plug 200' from incorrectly being inserted.

The electrical plug 200" can be inserted into the first mating opening of the electrical receptacle 100, and the upper tongue plate 112 of the electrical receptacle 100 is inserted into the receiving cavity 220", meanwhile the rib portions 114 passes the passageways 213". The second side walls 133 support a bottom wall of the shell 230" of the electrical plug 200" for ensuring a steady and reliable engagement. As the electrical plug 200" is longer than the second mating opening of the electrical receptacle 100, therefore the electrical plug 200" can not be inserted into the shorter opening.

Figure 9:
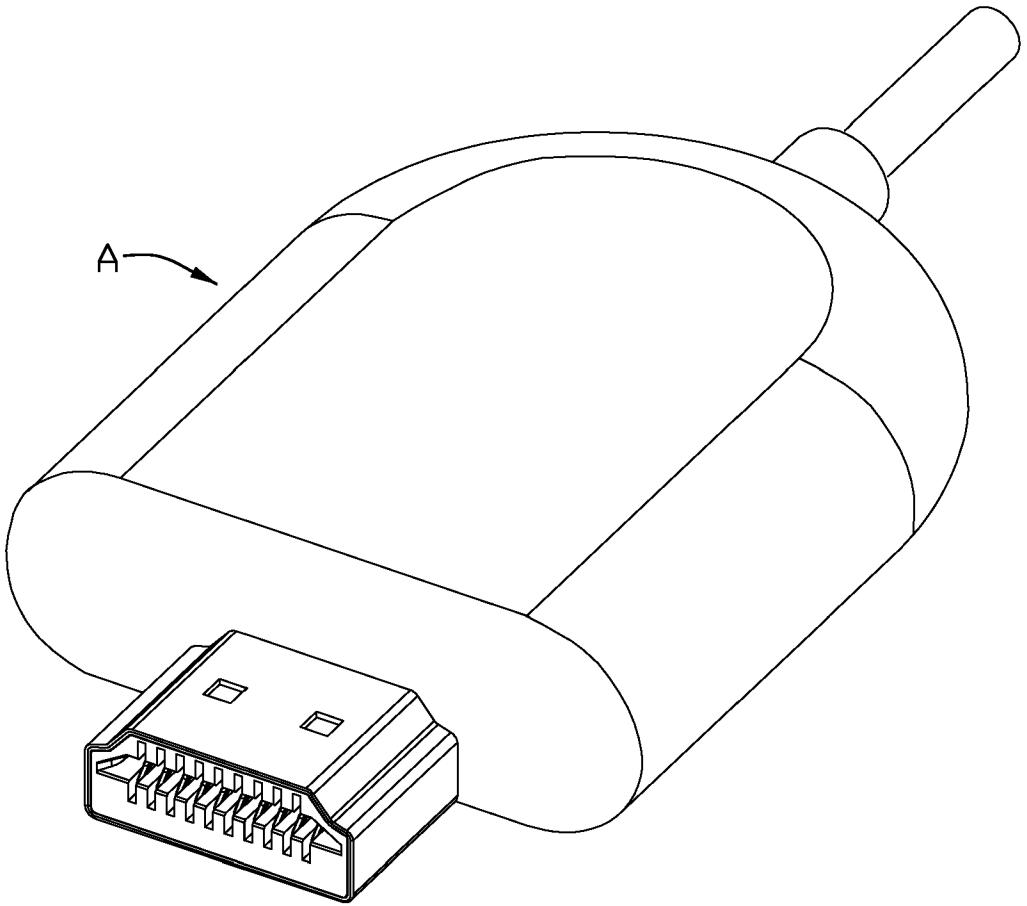
FIG. 9 is a perspective view of a fourth embodiment of the electrical plug, which is adapted for being inserted into the electrical receptacle shown in FIG. 2.
Figure 10:
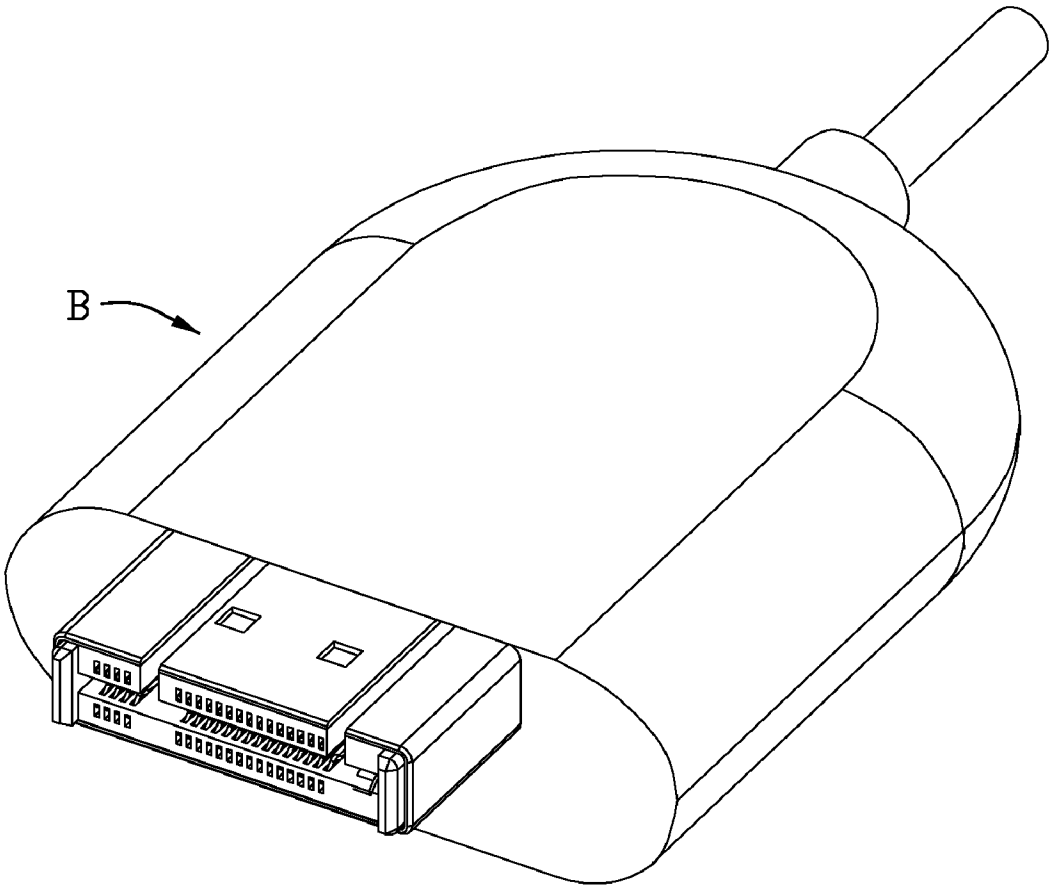
FIG. 10 is a perspective view of a fifth embodiment of the electrical plug, which is adapted for being inserted into the electrical receptacle shown in FIG. 2.
Figure 11:
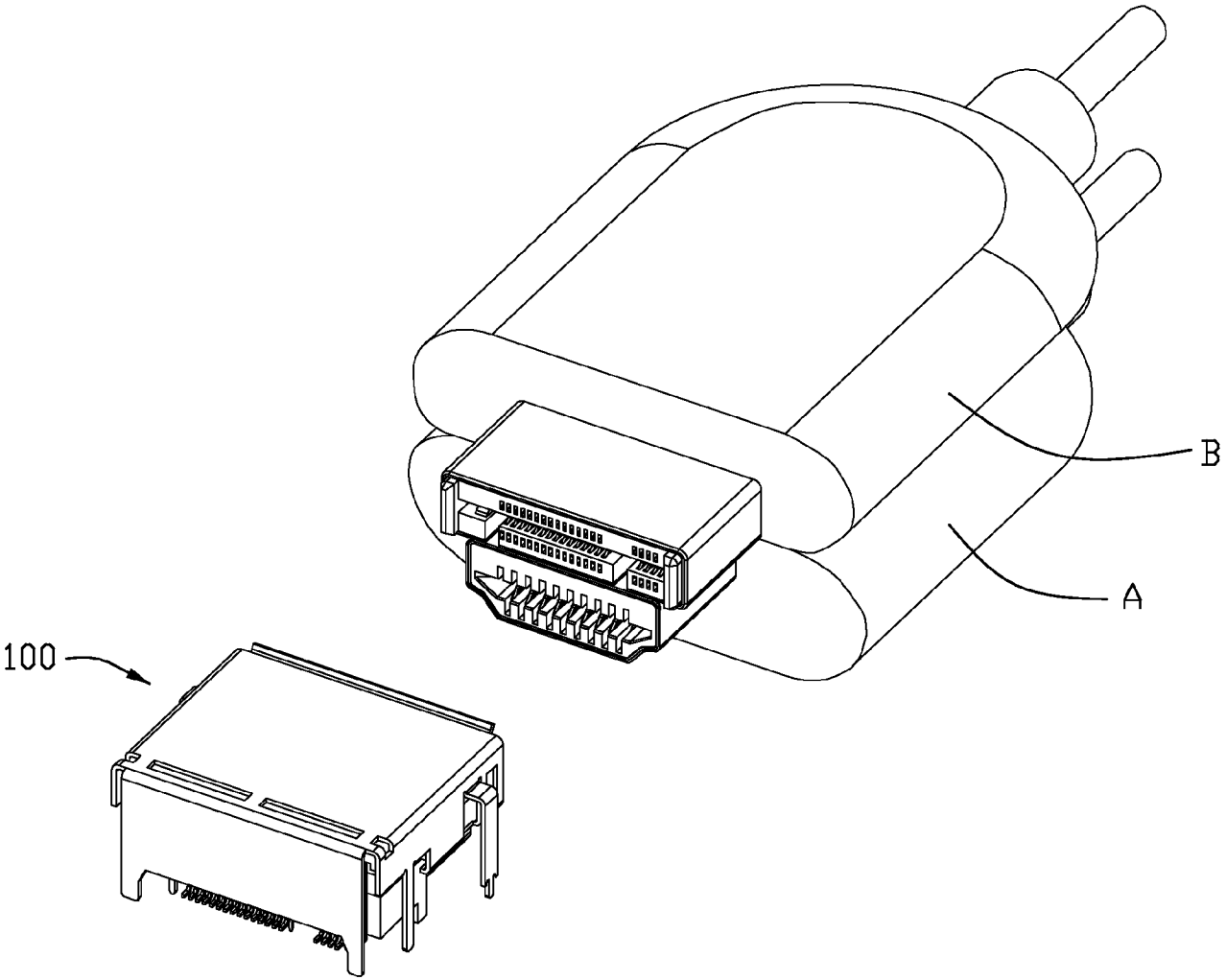
FIG. 11 is an assembled perspective view of the electrical receptacle shown in FIG. 2 being mating with the electrical plug shown in FIGS. 9 and 10.
Figure 12:
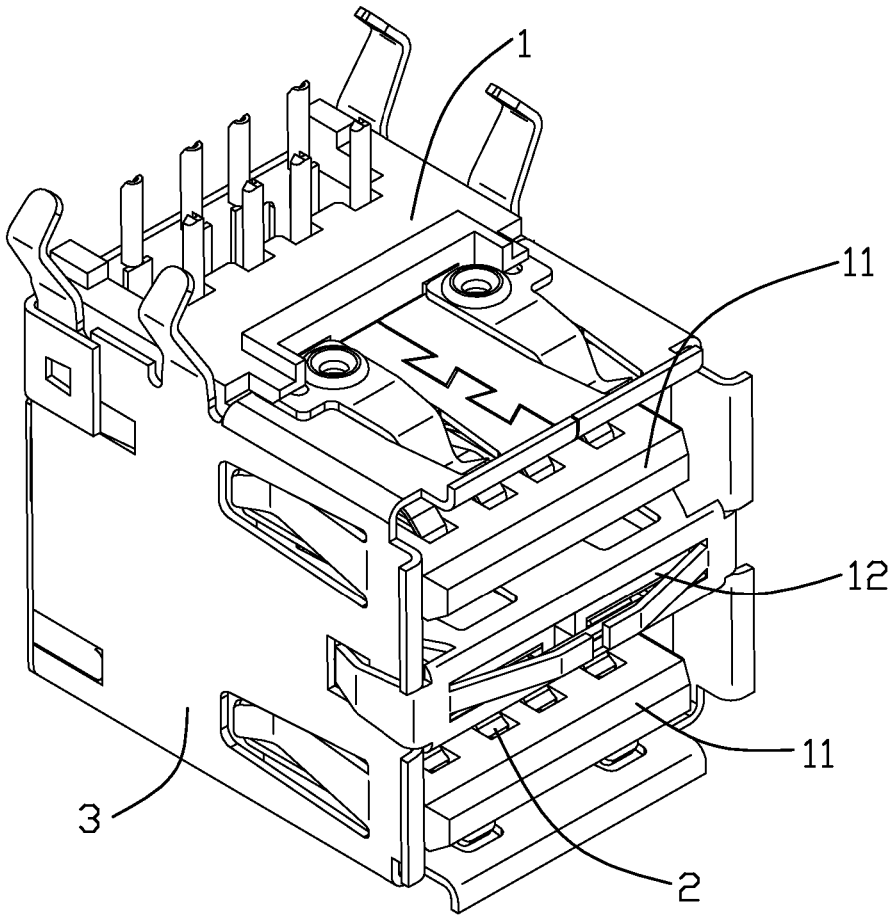
FIG. 12 (PRIOR ART)
FIG. 12 is a perspective view of an electrical plug of a prior art.

Referring to FIGS. 9-11, a fourth and fifth embodiments of the electrical plug A, B are provided for mating with the electrical receptacle 100, and the structures of the electrical plug A, B are modified little from the corresponding electrical plug 200', 200". As the electrical plug 200', 200" respectively has a big and thick cover for providing an operating portion for a user, the two electrical plugs 200', 200" can not be inserted into the mating opening 1301 at the same time. In order to overcome said problem, the electrical plugs A, B respectively modify their covers to a thin and compact type, that is to say, to cut off one side of the cover to keep the cover coplanar with a surface of the shell 230', 230". Under this condition, the electrical plugs A, B can be stacked together and inserted into the mating opening 1301 of the electrical receptacle 100 at the same time, which is best shown in FIG. 11.

The present invention provides an electrical plug 100 defining combo interfaces in one single port for respectively receiving two different plugs therein, which is preferable for the miniaturization trend of the electrical connector. More, the two interfaces of the electrical receptacle 100 are uninterrupted with each other and each interface can receive a complementary electrical plug individually and separately. And moreover, the two interfaces of the electrical receptacle 100 can receive a pair of special electrical plugs A, B therein at the same time.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a main body and a pair of tongue plates perpendicular extending forward from a front surface of said main body along a mating direction, said tongue plates being parallel to each other and each defining a plurality of terminal grooves thereon;

a plurality of terminals received in the terminal grooves; and a metallic shell retained on the main body of the insulative housing and enclosing said pair of tongue plates thereby defining a mating opening therein, said mating opening defining a first and a second different interfaces in communication with each other;

wherein at least a rib portion protrudes forward and downward from the front surface of said main body and received within the first interface, the rib portion also defines a bottom surface to act as a boundary between the first and second interfaces.

2. The electrical connector as described in claim 1, wherein the pair of tongue plates are respective received in the first and second interfaces, and the tongue plate in the first interface is longer than the tongue plate in the second interface in a transverse direction perpendicular to said mating direction.

3. The electrical connector as described in claim 2, wherein the rib portion is unitarily formed with the tongue plate in the first interface and projects toward the other tongue plate along a vertical direction perpendicular to the transverse direction and mating direction.

4. The electrical connector as described in claim 1, wherein the metallic shell forms a pair of side walls extending horizontally and in alignment with the boundary between the first and second interfaces.

5. The electrical connector as described in claim 4, wherein a pair of first vertical walls respectively extend upward from outermost ends of the side walls and a pair of second vertical walls respectively extend downward from innermost ends of the side walls, a transverse distance between the opposed first vertical walls is larger than that between the second vertical walls.

6. An electrical assembly comprising:

an electrical receptacle, comprising an insulative housing mounted a plurality of terminals thereon and a metallic shell surrounding the insulative housing thereby defining a mating opening therein, the metallic shell including a pair of horizontal walls extending into the mating opening toward each other along a transverse direction so as to divide the mating opening into a first interface and a second interface in communication with each other, the insulative housing forming a first and a second tongue plates respectively received in the first and second interfaces; and at least an electrical plug, comprising an insulative housing defining at least one receiving cavity for receiving said first or second tongue plates, a plurality of conductive components received in the insulative housing and a cover enclosing said insulative housing and conductive components;

wherein the first and second interfaces intimately neighbor and communicate with each other and at least one rib portion is formed on the insulative housing in the first interface and extends toward the second interface along a vertical direction perpendicular to the transverse direction for ensuring steady engagement between the plug and the receptacle when the electrical plug is inserted into the electrical receptacle.

7. The electrical assembly as described in claim 6, wherein the rib portion is unitarily formed with the first tongue plate with its bottom face in alignment with the horizontal walls.

8. The electrical assembly as described in claim 7, wherein the insulative housing of the electrical plug defines a pair of receiving cavities for respectively receiving the first and second tongue plates therein and at least one passageway for allowing the rib portion to be inserted into.

9. The electrical assembly as described in claim 7, wherein the insulative housing of the electrical plug defines a receiving cavity extending along the transverse direction and a passageway perpendicular to said receiving cavity and in communication with said receiving cavity, and the electrical plug is inserted into the first interface and said rib portion is received in the passageway.

10. The electrical assembly as described in claim 9, wherein the cover of the electrical plug is modified to be coplanar with a lower surface of the insulative housing of the electrical plug.

11. The electrical assembly as described in claim 7, wherein the insulative housing of the electrical plug defines a receiving cavity for receiving the second tongue plate therein, and the rib portion stands on the insulative housing of the electrical plug.

12. The electrical assembly as described in claim 11, wherein the cover of the electrical plug is modified to be coplanar with a top surface of the insulative housing of the electrical plug.

13. The electrical assembly as described in claim 12, wherein a second electrical plug is provided with a cover to be modified to be coplanar with a bottom surface of the insulative housing of the second electrical plug, therefore the two electrical plugs can be respectively inserted into the first and second interfaces at the same time.

14. The electrical assembly as described in claim 6, wherein there are first and second plugs each having respective complementary mating ports for respectively coupling to said first interface and said second interface, and said first interface and said second interface are not overlapped with each other in a vertical direction so as to allow the first plug and the second plug to be simultaneously inserted into the receptacle connector for being respectively coupled to the first tongue plate and said second tongue plate under condition that a side of the cover of said first plug facing to said second plug, is coplanar with the corresponding complementary mating port of the first plug, and another side of the cover of said second plug facing to said first plug, is coplanar with the corresponding complementary mating port of the second plug for avoiding interference between the covers of said first plug and said second plug when both said first and second plugs are coupled to the receptacle simultaneously.

15. The electrical assembly as claimed in claim 6, wherein said at least one rib portion functions as an orientation means for coupling the corresponding plug which is coupled to the first interface, and as an abutment means for coupling the corresponding plug which is coupled to the second interface.

16. The electrical assembly as claimed in claim 6, wherein said first interface is larger than the second interface in a first direction, and a boundary portion of said second interface intimately neighboring and facing the first interface in a second direction perpendicular to said first direction, is larger than another boundary portion thereof which is opposite said boundary portion and farther from said first interface in said second direction under condition that said rib portion is the only one restraint device, except said second tongue plate, for restraining the plug, which is coupling to the second interface, from moving toward the first interface in said second direction.

17. The electrical assembly as claimed in claim 16, wherein said first interface and said second interface are essentially stacked with each other in the second direction.

18. An electrical assembly comprising:

an insulative housing;

a metallic shell enclosing said housing and defining a mating opening therein, said shell including a pair of opposite horizontal side walls to thereof define and divide the mating opening into a large interface and a small interface respectively in a vertical direction to receive a large tongue plate and a small tongue plate which respectively extends from the housing, wherein said large interface is larger than the small interface in a transverse direction perpendicular to said vertical direction;

said large interface and said small interface intimately neighboring with each other in said vertical direction via sharing a same boundary while being configured to be respectively coupled to complementary mating interfaces of corresponding first and second plugs without interference in the vertical direction when said complementary mating interfaces of both said first plug and said second plug are simultaneously inserted in to the shell under condition that outer covers of both said first plug and said second plug are respectively coplanar with the corresponding complementary mating interfaces thereof without interference in the vertical direction.

* * * * *